United States Patent [19]

Spraggs et al.

[11] 3,987,732

[45] Oct. 26, 1976

[54] NON-ELECTRIC DOUBLE DELAY BOREHOLE DOWNLINE UNIT FOR BLASTING OPERATIONS

[75] Inventors: Richard William Spraggs, Simsbury; Ernest Laird Gladden, Granby, both of Conn.

[73] Assignee: The Ensign-Bickford Company, Simsbury, Conn.

[22] Filed: Feb. 10, 1975

[21] Appl. No.: 548,520

[52] U.S. Cl. ..... 102/27 R; 102/22 R

[51] Int. Cl.[2] ..... C06C 5/06

[58] Field of Search ..... 102/22, 27 R, 27 I, 102/28 R, 28 M

[56] References Cited

UNITED STATES PATENTS

| | | | |
|---|---|---|---|
| 927,968 | 7/1909 | Harle | 102/27 R |
| 3,420,174 | 1/1969 | Potter | 102/28 R |
| 3,590,739 | 7/1971 | Persson | 102/27 R |
| 3,709,149 | 1/1973 | Driscoll | 102/22 |
| 3,739,724 | 6/1973 | Tlam | 102/28 R |
| 3,878,785 | 4/1975 | Lundborg | 102/27 R |

*Primary Examiner*—Verlin R. Pendegrass

*Attorney, Agent, or Firm*—Prutzman, Hayes, Kale & Chilton

[57] ABSTRACT

A non-electric double delay borehole downline unit is provided for delaying transmission of an explosive signal down a borehole and also delaying initiation of the charge within the borehole after the signal has been received therein. The double delay unit comprises a length of flexible impulse propagating tubing having first and second ends and an impulse propagating hollow channel extending along the length thereof, a non-electric high strength blasting cap containing a first delay element connected to the first end for initiating a borehole explosive charge, an impulse amplifying and transmitting cap containing a second delay element connected to the second end and a protective block having a plurality of elongated apertures with one of said apertures fully and snugly receiving the amplifying cap therein.

9 Claims, 2 Drawing Figures

NON-ELECTRIC DOUBLE DELAY BOREHOLE DOWNLINE UNIT FOR BLASTING OPERATIONS

The present invention relates generally to explosive signal transmission assemblies for borehole blasting operations. More particularly it is concerned with a new and improved non-electric delay blasting unit for use in boreholes to provide a delay in both the initiation of the borehole charge and the transmission of the signal to succeeding boreholes.

In borehole blasting operations certain advantages have been achieved by providing dual delays for explosive signal transmission to each borehole charge. A first delay is provided at the detonator cap positioned within the borehole while a second delay controls signal travel into the borehole. Heretofore, in order to accomplish this, it has been necessary to splice a delay connector into the surface trunkline of the system and to use a blasting cap having a different delay interval within the borehole. Conventionally, the delay provided within the cap is of substantially longer duration than the delay provided by the surface connector. This assures that the signal is transmitted along the trunkline to a sufficient number of borehole downlines prior to the initiation of the explosive charge within the first borehole. Such sequential or rotational firing minimizes the possibility of cut-offs at the trunkline due to ground movement while at the same time reduces vibration and improves fragmentation in the blasting operation. As will be appreciated, dual delay blasting systems used heretofore have required warehousing of a number of different types of delay devices having different time delay intervals. From a practical standpoint, such blasting operations also have been limited to about seven to eight delays within the system in order to maintain the requisite control over the time delay period. Additionally, not only have two separate delay products been required but these products have also been extremely noisy in operation, and their use has been limited to those areas where their inherent noise character would not present a problem, thus limiting their use.

The present invention provides for a substantially more simplified delay hook-up for borehole blasting operations by the utilization of a single non-electric double delay borehole downline unit that will provide the requisite delay in sending the signal down the borehole as well as the appropriate delay in initiating the charge within the borehole after the signal has been received therein.

Another feature of the present invention is to provide a new and improved non-electric double delay borehole downline unit that effects millisecond delay blasting coupled with the efficiency of purchasing and warehousing only a single product while at the same time achieving these advantages at a substantially reduced noise level.

Still another object of the present invention is to provide a new and improved double delay unit of the type described wherein the explosive content of the assembly is significantly lower than presently available non-electric delay systems yet provides improved reliability and safety coupled with ease of hook-up and use of the same unit to initiate a larger number of sequentially fired holes.

A further object of the present invention is to provide a double delay unit of the type described that is capable of functioning as a replacement for a portion of the trunkline at substantially reduced noise levels and permits rapid, easy interconnection within the blasting system while exhibiting advantages of manufacture, distribution and use.

Other objects will be in part obvious and in part pointed out more in detail hereinafter.

These and related objects are accomplished in accordance with the present invention by providing a new and improved non-electric double delay borehole downline unit for both delaying transmission of an explosive signal down a borehole and also delaying initiation of the charge within the borehole after the signal has been received therein. This single double delay unit is comprised of a length of flexible explosive impulse propagating fuse or tubing having first and second ends and an impulse propagating channel extending along the length thereof. A non-electric high strength detonator or blasting cap containing a first delay element is connected to the first end of the signal propagating tubing for initiating the borehole explosive charge. Connected to the second end of the tubing is an impulse or signal amplifying and transmitting cap containing a second delay element. A protective connecting block having a plurality of elongated apertures protectively houses the amplifying and transmitting cap within one of the apertures and fully and snugly retains the cap while facilitating interconnection with adjacent signal transmitting lines.

A better understanding of the invention will be obtained from the following detailed description and the accompanying drawing of an illustrative application of the invention.

DESCRIPTION OF A PREFERRED EMBODIMENT

Figures 1, 2:
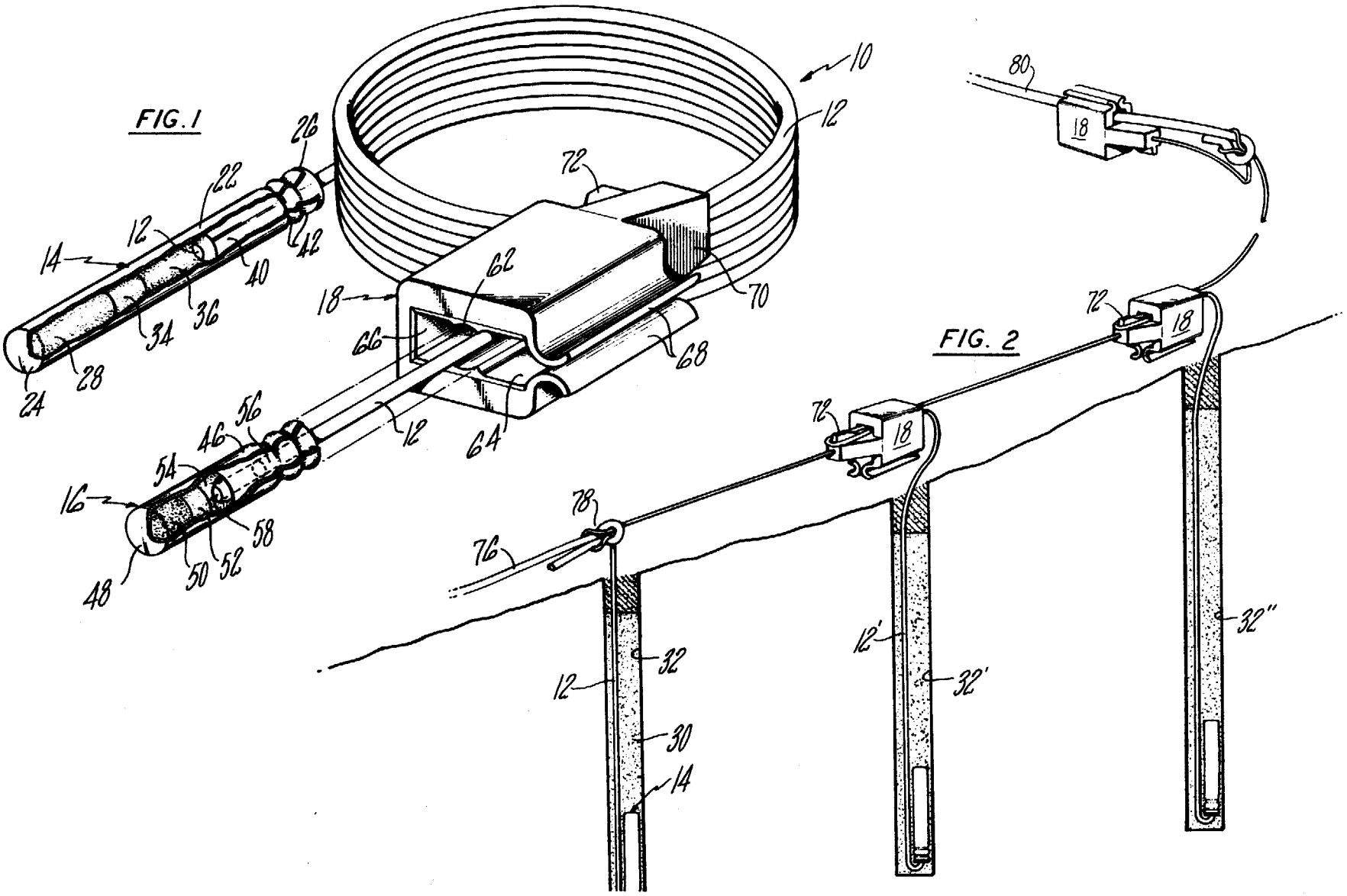
FIG. 1 is an exploded perspective view partially broken away and partially in section of the double delay borehole downline unit of the present invention.
FIG. 2 is a diagrammatic view of a portion of a borehole blasting operation illustrating the use of the double delay borehole unit of FIG. 1 and its interconnection with both similar double delay units and a detonating cord trunkline.

Referring now to the drawing in greater detail wherein like reference numerals indicate like parts throughout the figures, the double delay borehole downline unit 10 of the present invention is shown as consisting essentially of a length of flexible explosive impulse or signal propagating tubing, fuse or the like 12 with a high strength detonator or blasting cap 14 connected to one end thereof and an impulse amplifying and transmitting cap 16 connected to the opposite end thereof and housed within a protective plastic connecting block 18.

The explosive impulse or signal transmitting tubing or fuse 12 of the assembly is a relatively long, flexible tubular member of varied length made of resilient material that possesses a relatively high degree of flexibility. As will be appreciated, the length of the fuse 12 will be determined by the ultimate use of the double delay unit and generally will vary from about 4 to 6 feet in length up to about 100 or more feet with the preferred length being about 40 feet. The signal transmitting fuse is a tubular member made from tough, durable plastic material, such as polyethylene, polyvinyl chloride or similar materials. For example, the ionic polyethylene sold by E. I. Dupont under the name "Surlyn" has been used with success. While the cross sectional dimensions of the tubing may vary, it should be of a size that will accommodate a thin coating (not shown) of fine granular explosive material on the interior wall or surface of the tubing yet leave a continuous hollow central gas channel extending axially therealong. Thus the tubing is generally less than about 10 millimeters o.d. and preferably less than 5 millimeters o.d., while excellent results have been obtained with tubing exhibiting an outside diameter of 3 millimeters and an inside diameter of 1.5 millimeters. The thin layer of explosive is comprised of fine granular particles in the range of 1–100 microns and is present in an amount sufficient to sustain a percussion wave of high velocity along the entire length of the plastic fuse 12. The thin layer of explosive may include a particulate high explosive material such as PETN, RDX, HMX, or the like and the fuse should preferably be of the type described in greater detail in U.S. Pat. No. 3,590,739, the contents of which is incorporated herein by reference. The particulate explosive material within the fuse 12 is present in amounts that generally do not exceed 0.5 grams per meter and preferably the core load is well below 0.1 grams per meter. As will be appreciated, the amount of explosive used in an individual fuse will vary somewhat with the diameter of the plastic tubing. For example, an explosive mixture of about 0.05 grams per meter would be adequate for a tubular fuse having an inside diameter of 3 millimeters while an explosive layer of about 0.02 grams per meter is preferred for plastic tubing having an inside diameter of 1.5 millimeters. As will be appreciated, the explosive layer will only be about one particle in thickness and will provide a wave transmission velocity of about 2,000 meters per second yet will not cause rupture of the plastic tubing.

One of the advantageous features of utilizing this type of signal transmitting tube for the explosive signal propagating function is its inherent noiseless character and insensitivity to inadvertent initiation by fire or impact. Thus it can be used in areas where excessive noise is objectionable and readily lends itself to the safety and reliability associated with factory assembly as contrasted to the on-site splicing of delay connectors into the trunkline of borehole blasting systems. Advantageously, it also provides confined signal transmission and will not rupture or cause side initiation of detonating cord and the like, thereby adding an additional safety factor.

The non-electric high strength detonator or blasting cap 14 connected to one end of the signal transmitting fuse 12 is similar to conventional delay blasting caps used in the blasting industry. The cap includes a metal cap shell 22 of tubular configuration that is closed at its free end 24 and is crimpably connected at its opposite end 26 to the signal transmitting fuse 12. The metal shell may be of steel, aluminum or similar protective material. An explosive base charge 28 is positioned within the shell at the closed end 24 thereof. The charge is of sufficient size to initiate an explosive load 30 within a borehole 32 (see FIG. 2) and may be comprised of any one of the conventional types of high explosives generally used as the base charge in blasting detonators. For example, the charge may comprise about 3–25 grains and preferably 5–18 grains of RDX, HMX, TNT or mixtures thereof but preferably about 12 grains of PETN is used in most instances. As will be appreciated, the powder explosive may be aluminized or treated with flow aids, antistatic agents or other additives.

Immediately adjacent and in abutting relationship with the base charge 28 is a top or primary charge or layer 34 of an initiating or primary explosive mixture, such as lead azide. As will be appreciated, the layer 34 need only be of sufficient size to assure ignition of the charge 28. Accordingly, a charge 34 of about 1–2 grains is usually sufficient. Other primary explosives such as lead styphnate, DDNP, HNM or mixtures thereof may be used in conjunction with or in place of the lead azide.

In propagating relationship with the top charge 34 is a delay element 36 that may be in the form of a pressed pyrotechnic charge or pellet similar in size and shape to the explosive charges 28 and 34, as shown in FIG. 1, or it may take the form of a pyrotechnic rod sheathed within a lead or aluminum tubing or within some other suitable sheathing material. The pyrotechnic composition may vary depending upon the delay period required but generally consists of mixtures of boron, tungsten, titanium, zirconium, silicon, molybdenum, barium chromate, lead oxide aand alkaline metal nitrates, chlorates, and perchlorates. As mentioned hereinbefore, the delay element 36 within the detonator cap 14 will generally provide a signal delay time that is substantially greater than the delay provided by the impulse amplifying and transmitting cap located on the opposite end of the explosive impulse transmitting fuse.. Thus, the delay element within the detonator may conveniently be comprised of a mixture of boron and barium chromate that exhibits a signal time delay of about 200 milliseconds while the delay provided by the amplifying and transmitting cap would have a delay that is of shorter duration by a factor of about 2 to 20, as for example, a delay of 9 to 35 milliseconds with most units exhibiting a delay of about 17 or 25 milliseconds.

As shown in the drawing, a plastic bushing or adapter 40 is positioned immediately adjacent the delay element 36 to provide an appropriate butt connection between the explosive signal transmitting fuse 12 and the delay element 36. The bushing 40 is an elongated tubular plastic member provided with an axial cavity having a diameter only slightly larger than the signal transmitting fuse so as to readily receive the fuse therein and position it in propagating relationship with the delay element. The adapter can be constructed of any suitable plastic material such as polyethylene, nylon, ABS, rubber, vinyl or copolymers thereof such as the preferred material of an ethylene vinyl acetate copolymer. Since the adapter is primarily used for the purpose of adapting the signal transmitting fuse 12 to the metal shell 22 of the cap, it exhibits an outside diameter that permits its ready acceptance by the cap shell. As will be appreciated, the delay element may assume a rod-like form comparable in size to the signal transmitting fuse, in which case the bushing may be of sufficient length to receive the delay element also within its axial aperture for positioning adjacent the top charge 34. As shown, the blasting cap 14 is secured to the end of the signal transmitting fuse 12 by suitably crimping the metal shell of the cap adjacent its open end, as indicated by the numeral 42 and, as desired, within the area of the delay element.

The signal amplifying and transmitting cap 16 attached to the opposite end of the signal transmitting fuse 12 from the blasting cap or detonator 14 is generally of similar construction to the detonator except that it is of somewhat shorter length and contains considerably less explosive within the main explosive charge. In fact, the charge in cap 16 is generally one half to one tenth as large as in the detonator 14.

As can be seen in the drawing, the amplifying and transmitting cap 16 includes a cap shell or similar container 46 such as an aluminum or plastic tubular sleeve constructed of polycarbonate or the like and is provided with a closed end portion 48 having an interior filler layer 50 of an explosively inert material. The primary function of the inert filler located adjacent the closed end 48 is to dampen the transmission of the explosive signal through the end of the tube and promote the side initiating function thereof. The explosively inert material may be any one of a variety of materials well suited for that purpose and may include materials such as plastic, sugar, diatomaceous earth or similar material of a granular consistency.

As mentioned, the base explosive charge 52 located immediately adjacent the explosively inert filler layer 50 is of smaller size but may be comprised of substantially the same explosive materials as the base charge 28 of the detonator cap 14. Thus the charge 52 may consist of only 1–2 grains of explosive as compared to about 5 to 28 grains for the charges 28 and 34 of detonator 14. Similarly the preferred material for the base charge 52 is PETN or one of the other explosive materials listed hereinbefore. When the base charge is PETN or the like, it is generally preferred that a top charge 54 of lead azide be provided although other suitable primary explosives may be used in place of the lead azide.

In a manner similar to the detonator 14, a bushing or adapter 56 is provided and, as shown, is assembled in contact with the top charge 54 since it houses both a delay element 58 and the signal transmission fuse 12 within its central or axial cavity. The delay element 58 also may be in the form of a pressed pyrotechnic charge or pellet similar in shape to the pellet 36 shown within the detonator 14 or it may be a rod-like sheathed pyrotechnic material. The delay material includes the pyrotechnics mentioned hereinbefore. In any event the delay element provides a predetermined operating time interval that may be of any suitable duration so long as it is of shorter duration than the delay provided within the detonator 14. Thus, a time delay of from 5 milliseconds to 100 milliseconds or any other suitable delay interval capable of providing the requisite sequential or rotational borehole firing in commercial blasting operations can be utilized. As mentioned, good results have been achieved utilizing a mix of boron and red lead to provide millisecond delays of 17 and 25 milliseconds. Accordingly, with a delay of 200 milliseconds in the detonator 14 it will be appreciated that the surface hook-up will provide complete functioning at the signal amplifying and transmitting cap 16 and transmission of the signal downline a sufficient distance so that it is well removed from and escapes damage as a result of the initiation of the explosive charge within the preceding boreholes.

The protective block 18 that houses the signal amplifying and transmitting cap 16 takes the form of a generally rectangular plastic member of polyethylene or similar protective plastic material having a central aperture 62 extending longitudinally along the block for fully and snugly receiving the amplifying cap 16. The block 18 may take any one of a number of different forms or designs as shown in the U.S. Pat. No. 3,878,785 of Hans K. Lundborg, entitled "Propagating Device and Initiation System for Low Energy Fuses," the content of which is incorporated herein by reference. In the embodiment illustrated, the block 18 is provided with a pair of aligned longitudinally extending cavities 64, 66 positioned on opposite sides of the central aperture 62 and in full communicating relationship therewith along their entire length. Side cavity 64 is provided with a pair of flared lip portions 68 along one longitudinal side wall of the block 18 to facilitate snap-on insertion of a detonating cord or similar fuse into cavity 64. In this way the connected fuse is firmly held in abutting side-by-side relationship with the amplifying and transmitting cap housed within aperture 62. The cavity 66 on the opposite side of the central aperture 62 permits threaded attachment of a similar or different signal transmission tubing such as a length of signal transmission tubing of the type described in U.S. Pat. No. 3,590,739. In such an arrangement an integral stabilizing end lug 70 is provided to control the flexibility of the housing block 18 and a lateral flange 72 extends outwardly therefrom in alignment with cavity 66 to permit the signal transmission tubing extending through cavity 66 to be looped around the flange for retention of the fuse within the connecting block 18.

As will be appreciated from the foregoing description and as shown in FIG. 2, the non-electric double delay borehole downline unit 10 of the present invention can be loaded within a suitable borehole 32 to provide direct initiation of a properly formulated explosive 30 such as an ammonium nitrate/fuel oil mixture. The detonator 14 of the unit 10 is located within the borehole 32 and is operatively connected through the signal transmission fuse 12 to a suitable initiating device such as a detonating cord 76 or a specially designed starter unit. As shown the cord 76 is connected to the signal transmission cord 12 through a knot 78 at a point intermediate the ends of the fuse 12. A second non-electric double delay unit is similarly positioned within a subsequent borehole 32' and is interconnected with the signal amplifying and transmitting cap 16 of the first double delay unit. As shown, the block 18 of the first unit receives an intermediate portion of fuse 12' of the second unit within cavity 66 and around flange 72. In this way the fuse 12' is held in signal propagating relationship to cap 16 of the first unit 10 to facilitate signal transmission therebetween. As will be appreciated, similar interconnections can be made to provide the initiation of any number of subsequent boreholes such as borehole 32'' or, as shown, one of the amplifying and transmitting caps can be connected to another length of detonating cord 80 by positioning the cord 80 within cavity 64 through lips 68 for further transmission of the explosive signal.

Thus, upon actuation of the initial detonating cord 76, the first explosive signal transmitting fuse 12 will be initiated to provide signals traveling in both directions from the point of interconnection 78 with the detonating cord. The signals will be fully confined within tube 12 and will substantially simultaneously initiate the operation of the delay element 36 within the detonator 14 and the delay element 58 in the amplifying and transmitting cap 16. Since the delay element 58 in cap 16 provides a substantially shorter delay time interval, the base charge 52 of the amplifying and transmitting cap is the first to be actuated and in turn initiates a signal within fuse 12' of the second unit, which signal also progresses simultaneously in opposite directions towards its respective detonator and signal transmitting cap. Thereafter the sequence is repeated until such time as the final downline unit either terminates the signal or provides initiation of another detonating cord or the like, such as cord 80.

As will be apparent to persons skilled in the art, various modifications, adaptations and variations of the foregoing specific disclosure can be made without departing from the teachings of the present invention.

We claim:

1. A preassembled non-electric double delay borehole downline unit for sequential firing blasting operations for delaying both initiation of a charge within a first borehole after the signal has been received therein and passage of signal transmission down a second borehole and toward succesive boreholes comprising a length of flexible impulse propagating tubing having first and second ends and an impulse propagating hollow channel extending along the length thereof, a non-electric high strength blasting cap containing a first delay element connected to said first end for initiation by an impulse traveling along said channel and for initiating the borehole explosive charge within said first borehole, an impulse amplifying and transmitting cap containing a second delay element connected to said second end for initiation by an impulse traveling along said channel and for delaying signal transmission beyond said transmitting cap, said delay elements being comprised of pyrotechnic material having different time delay periods with said first delay element having a substantially longer time delay period than said second delay element and a protective block having a plurality of elongated apertures with one of said apertures fully and snugly receiving said amplifying cap therein.

2. The double delay unit of claim 1 wherein said first delay element provides a delay that is at least about twice as long as the delay provided by said second delay element.

3. The double delay unit of claim 1 wherein the tubing is provided with an interior coating of explosive having a core load of less than 0.5 grams per meter.

4. The double delay unit of claim 1 wherein the explosive charge ratio between blasting cap and the impulse amplifying and transmitting cap is at least about 2:1.

5. The double delay unit of claim 1 wherein the impulse amplifying and transmitting cap includes a tubular shell closed at one end and containing an explosively inert material at said closed end, an explosive charge immediately adjacent said inert material, said charge being of sufficient size to transmit an explosive signal through said shell, said second delay element being positioned within said shell intermediate said charge and the impulse propagating tubing.

6. The double delay unit of claim 1 wherein the protective block is a plastic member and said elongated apertures are arranged in parallel side-by-side abutting relationship.

7. The double delay unit of claim 1 wherein said protective block includes an aperture having flexible lip portions along the length thereof permitting snap-on insertion of a fuse into said aperture.

8. The double delay unit of claim 1 wherein said delay elements include a pyrotechnic mixture of boron and an oxidizer.

9. The double delay unit of claim 1 wherein said first delay element provides a delay of about 200 milliseconds and said second delay element provides a delay of about 9–35 milliseconds.

* * * * *